US005301524A

United States Patent [19]

Georgopoulos et al.

[11] Patent Number: 5,301,524

[45] Date of Patent: Apr. 12, 1994

[54] REPAIRABLE KEY FOR PLUNGER LOCK

[75] Inventors: George Georgopoulos, Pine Brook; Richard C. Dreisbach, North Arlington, both of N.J.

[73] Assignee: E. J. Brooks Company, Newark, N.J.

[21] Appl. No.: 49,034

[22] Filed: Apr. 15, 1993

[51] Int. Cl.[5] ..... E05B 19/18

[52] U.S. Cl. ..... 70/34; 70/404; 70/386

[58] Field of Search ..... 70/32-34, 70/38 A, 38 B, 38 C, 38 R, 386, 395, 397-399, 404

[56] References Cited

U.S. PATENT DOCUMENTS

| | | | |
|---|---|---|---|
| 4,015,456 | 4/1977 | Moberg | 70/34 |
| 4,144,729 | 3/1979 | Nielsen, Jr. | 70/63 |
| 4,155,232 | 5/1979 | Haus, Jr. et al. | 70/34 |
| 4,252,006 | 2/1981 | Swisher | 70/34 |
| 4,254,647 | 3/1981 | Finck, Jr. | 70/77 |
| 4,296,616 | 10/1981 | Guiler | 70/34 |
| 4,483,164 | 11/1984 | Nielsen, Jr. et al. | 70/398 X |
| 4,492,100 | 1/1985 | Swisher | 70/34 |
| 4,513,591 | 4/1985 | Carlson et al. | 70/34 |
| 4,635,452 | 1/1987 | Agbay | 70/34 |
| 4,712,395 | 12/1987 | Agbay | 70/34 |
| 4,751,831 | 6/1988 | Morris et al. | 70/34 X |
| 4,840,049 | 6/1989 | Russo | 70/34 |
| 5,027,624 | 7/1991 | Agbay et al. | 70/34 |

*Primary Examiner*—Peter M. Cuomo
*Assistant Examiner*—Suzanne L. Dino
*Attorney, Agent, or Firm*—William Squire

[57] ABSTRACT

A hand repairable plunger lock key includes a hollow body in which is hand inserted or removed a pair of springs and a cartridge which tends to periodically wear out and require replacement. A cap is threaded to the body and is manually removed or attached without tools. A key operating cam has a pin which is releasably secured to a mating slot in the cartridge operating shaft which protrudes from the cap. The body and cap are resiliently displaced a distance sufficient for the slot to be engaged or disengaged with the cam pin. Once engaged, the body and cap are released to normally bias the pin to the shaft slot via springs in the key used to bias the cam against the cap.

10 Claims, 2 Drawing Sheets

REPAIRABLE KEY FOR PLUNGER LOCK

FIELD OF THE INVENTION

This invention relates to keys for use with plunger locks of the type including expansible balls for locking the locks to mating female locking bodies.

BACKGROUND OF THE INVENTION

Plunger operated locks are typically used to secure utility electric meters. A plunger operated lock arrangement is disclosed in U.S. Pat. No. 4,254,647 for example. Here the lock is used to secure a box in which an electric utility meter is enclosed. The plunger may be of any commercially available construction and may be, for example, of the type disclosed in U.S. Pat. No. 4,015,456. Other types of plunger locks are also available such as disclosed in U.S. Pat. No. 3,186,196 referred to in the U.S. Pat. No. 4,015,456 patent.

A so called key is required to operate these locks. For example reference is made to U.S. Pat. No. 4,296,616 and also to the '196 patent referenced above. In the plunger, a pin is biased away from a housing opening to a lock position and may be pulled to the unlock position. The pin is pulled by the so called key to the unlocked state. The key comprises an operating rod having an enlarged head which serves as a cam. The head and rod are within a sleeve formed into resilient segments or jaws. The enlarged head operates the jaws to expand them, the jaws having a quiescent state in which they are contracted. The jaws are inserted in the plunger lock and expanded to grab the pin therein to place the lock in its unlock state.

The keys comprise a mechanism within a housing and whose parts for operating the enlarged head and jaws are secured together in a manner such that factory disassembly is required. For example the jaws and head are part of a cartridge, which with springs, are inserted in a housing whose parts are staked together such that tools are required to disassemble the housing. Further, a handle coupled to the head operating rod is pinned to a shaft of the cartridge such that tools are required to disassemble this pinned arrangement. The repetitive operation of the head and jaws wears out the head and jaws so that the key periodically requires replacement. This requires the utility or other owner of the key and plunger locks to periodically return the key to the factory for repair. As a result, extra keys are required by the user which is costly and also the keys tend to be used until inoperative which is a nuisance.

SUMMARY OF THE INVENTION

The present inventors recognize a need to make the key repairable in the field so that users of the key can repair the worn head and jaws without returning the key to the factory for repair. A repairable key according to the present invention for use with a plunger lock having a pair of expandable balls in a cavity in which the key is inserted to selectively expand the balls to a locking state or retract the balls to an unlock state comprises a cylindrical body having an axis with an axially extending first bore, the body having a proximal end and a distal end with openings at each end in communication with the bore, the distal end opening being restricted in transverse dimension relative to the proximal end opening.

A cylindrical cap has a second bore for axially receiving the body, the cap having proximal and distal ends with openings at each end in communication with the second bore, the cap proximal end opening being restricted in transverse dimension relative to the distal end opening, the cap distal opening being sufficient to receive the body therethrough.

Expandable jaw cartridge means are included for placing the balls in the lock and unlock states, the jaw cartridge means including a collar and ball operating hollow core expandable jaws extending from the collar and a plunger including a jaw expanding portion resiliently secured in the core for selectively expanding the jaws in response to axial displacement of the plunger. The plunger includes a shaft. The jaws are dimensioned to pass through the body distal end opening. The collar is dimensioned greater than the distal end opening such that the collar is retained in the first bore and the jaws extend beyond the distal end. The cartridge means includes means in the first bore coupled to the shaft and collar for permitting resilient axial displacement of the shaft relative to the body for selective expansion of the jaws. The shaft has a portion which passes through the cap proximal end opening with the body received in the cap bore. Means releasably secure the cap to the body with the shaft portion extending through the cap proximal end opening so the cap and cartridge means can be removed by hand from the body without tools.

According to an embodiment of the present invention, the means for releaseably securing comprises an opening in the shaft portion and further includes handle means including means which mate with the shaft opening for releaseably securing the handle means to the shaft portion for release by hand without tools.

According to a further embodiment, the opening is a hook shaped slot in a side of the shaft, the handle means comprising a cam portion and a handle portion extending from the cam portion. The cam portion includes a pin dimensioned to be received in the slot through the shaft side. The cam portion is dimensioned to cam against the cap proximal end at a cam surface with the pin attached to the shaft for selectively withdrawing the shaft from the cap and body for the resilient axial displacement.

IN THE DRAWING

FIG. 1*a* is a side elevation view of a key device according to one embodiment of the present invention;

FIG. 1*b* is a side elevation partially in section view of the device of FIG. 1*a;*

DESCRIPTION OF THE PREFERRED EMBODIMENT

Figure 1A:
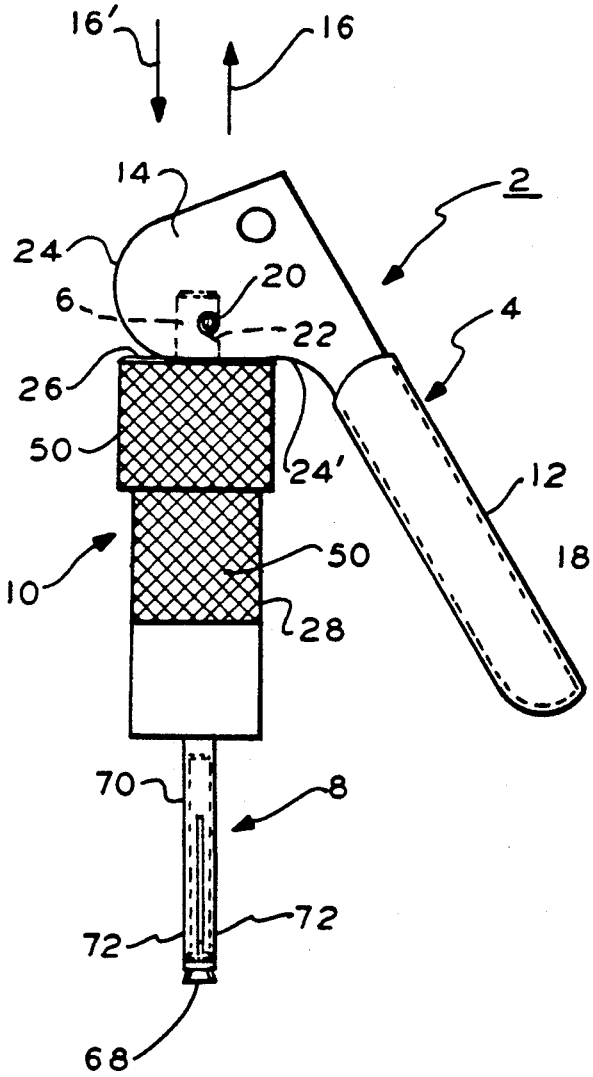

In the figures, identical parts have the same reference numeral. In FIG. 1*a*, key device 2 comprises a key operating handle and cam 4 releasably secured to shaft 6 of cartridge assembly 8 secured within housing 10. Cam 4 includes a handle portion 12 and a cam portion 14. The cam portion 4 has a locking pin 20 which is releasably inserted in slot 22 in a side of the shaft 6, FIG. 1*b*. The slot 22 is hooked shaped so that a force in direction 16 on pin 20 locks the pin in place.

The cam portion 14 comprises two parallel plates, only one being visible in the figures. Cam portion 14 has a cam surface 24 which is defined by a figure of revolution shaped to displace shaft 6 in direction 16 as handle 12 and the cam portion are rotated in direction 18. When so rotated, surface 24 of the cam portion 14 cams against the surface 26 of the housing 18 forcing the shaft 6 in direction 16. In order to insert pin 20 into slot 22, the shaft needs to be driven in direction 16 a distance so that the pin 20 can be engaged with slot 22. The distance between slot 22 and surface 26 normally is smaller than the distance between pin 20 and surface 24', the smallest distance between cam surface 24 and the pin 20. The cam portion 14 surface 24 normally resiliently engages cap surface 26. The shaft 6 is resiliently biased in direction 16' opposite direction 16 by cartridge assembly 8, thereby resiliently securing the cam 4 to the shaft 6 via pin 20 and slot 22.

Figure 1B:
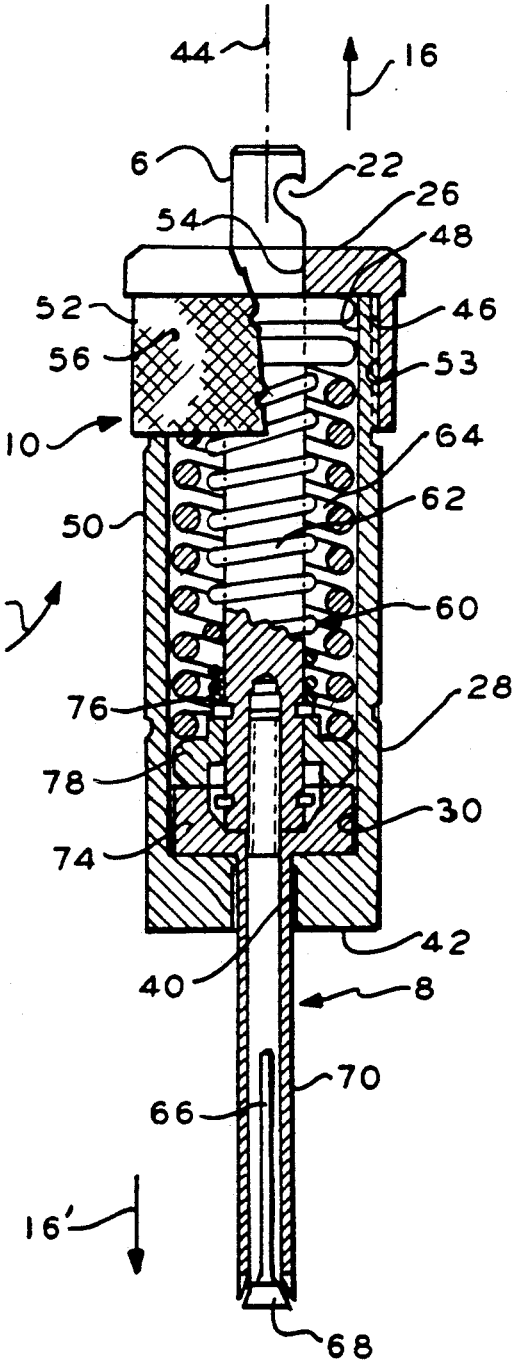

In FIG. 1*b*, the housing 10 comprises a metal body 28 having an axially extending bore 30 along axis 44. A bore 40 of restricted diameter is at distal end 42 of the body 28 on axis 44. External threads 46 are at the opposite proximal end of the body 28 and extend to the edge of the body 28. The bore 38 is open at the threaded proximal end of body 28. The body 28 has knurls 50 on its exterior surface. A cap 52 has a threaded bore 53 which is threaded to body 28 threads 46. The cap 52 at its proximal end has an opening 54 on axis 44 of restricted diameter through which shaft 6 passes. The distal end of the cap receives the body 28. The cap 52 is removable from the body 28 by hand without tools as is the cam 4. The cap 52 has external knurls 56 for this purpose, a person grabbing the knurls 50 of the body and the knurls 56 of the cap for rotating the cap from the body.

Figure 2:
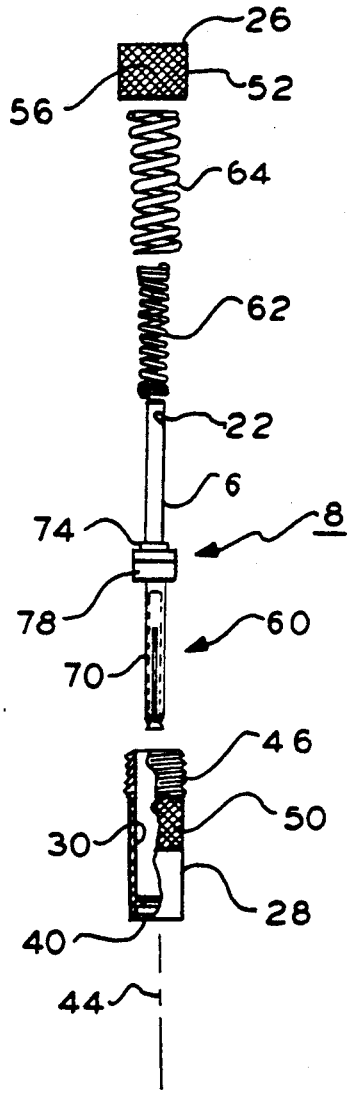
FIG. 2 is an exploded elevation view of the device of FIG. 1*b;*

In FIGS. 1*b* and 2, cartridge assembly 8 is conventional and is described in more detail in the aforementioned U.S. Pat. Nos. 3,186,196; 4,296,616 and patents mentioned in these documents, which patents are incorporated by reference herein. Briefly, the cartridge assembly 8 includes a cartridge 60 and two compression springs 62 and 64. The cartridge 60, FIG. 1*b*, comprises a rod 66 having an enlarged frustroconical head 68 at an end thereof. The rod 66 is secured to shaft 6 at the other rod end. A sleeve 70 having resilient fingers 72 at an end thereof receives the rod 66 therein. The fingers 72 form gripping jaws for gripping the mating part in the plunger lock (not shown) for displacing the ball retracting and expanding component of the plunger lock. The sleeve 70 is attached to a collar 74 at its other end. A spring (not shown) resiliently biases the head 68 along axis 44 out of engagement with the sleeve fingers 72.

When the head 68 is displaced axially in direction 16, it enters the sleeve 70. This expands the fingers 72 for engagement with the mating plunger lock (not shown in the Figures) illustrated in certain of the patents mentioned in the introductory portion.

Compression spring 62 abuts a retainer 76 secured to shaft 6 for biasing shaft 6 in direction 16' in the housing 10. Compression spring 64 abuts collar ring 78 which abuts collar 74 for biasing sleeve 70 in direction 16'. The compression springs 62 and 64 are concentric with the shaft 6 in the bore 30 of the body 28.

Figure 3:
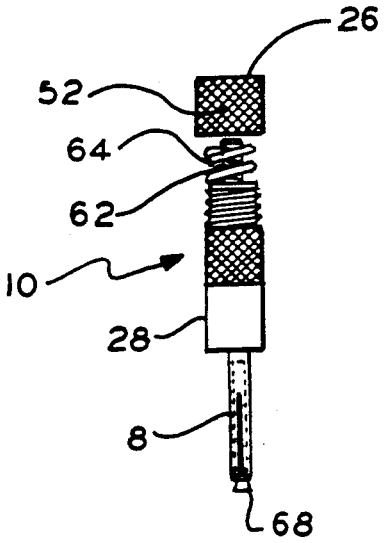
FIG. 3 is a view similar to that of FIG. 2 wherein the device is more completely assembled.

In FIG. 2, the cartridge 60 is inserted first into the bore 30 proximal end along axis 44 until the collar 78 abuts the body 28 adjacent to bore 40. The springs 62 and 64 are then inserted next over shaft 6 into bore 30 to form the assembly shown in FIG. 3. The cap 52 is then threaded by hand to the body 28 threads securing the cartridge assembly 8 to the bore 30, FIG. 1*b*.

Figure 4:
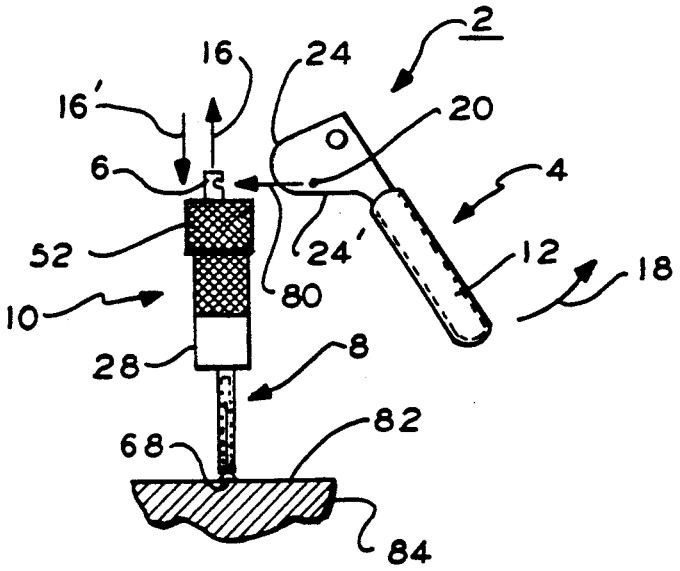
FIG. 4 is a view similar to that of FIG. 3 wherein the device of FIG. 3 is assembled and the handle for operating the device is shown in exploded view.

In FIG. 4, to assemble the cam 4, the cam is manually displaced in direction 80 toward shaft 6. Meanwhile, the housing 10 containing the cartridge assembly 8 is placed with the head 68 abutting a surface 82 of a support 84. The housing 10 is then gripped and manually pushed down toward the support 84 while head 68 abuts the support surface 82. This resiliently extends the shaft out of the body 28 in direction 16 displacing the slot 22 away from the cap 52. When the slot 22 is sufficiently displaced, the pin 20 of the cam 4 is inserted into the slot 22 in direction 80. At this time the housing 10 is released, the shaft resiliently retracts into the bore 30 of the body 28 and resiliently, releasably secures the cam 4 to the shaft 6.

To disassemble, the reverse process is used by urging the shaft 6 in direction 16 and separating the cam 4 pin 20 from slot 22. Then the cap 52 is removed by hand, the springs 62 and 64 easily slip out of the bore 30 as does the cartridge 8 which is replaced with a new cartridge and the process reversed once again to assemble the new cartridge.

There thus has been shown a key device for use with a plunger lock in which the key device can be disassembled by hand and a worn cartridge replaced with a new cartridge by hand. The user of the key device need only keep a supply of new cartridges and need not return the entire assembly to the factory for repair. The repair can be made in the field by a person carrying the key and a replacement cartridge.

What is claimed is:

1. A repairable key for use with a plunger lock having a pair of expandable balls and a cavity in which the key in inserted to selectively expand the balls to a locking state or retract the balls to an unlock state, said key comprising:

a cylindrical body having an axis with an axially extending first bore, said body having a proximal end and a distal end with openings at each end in communication with the bore, the distal end opening being restricted in transverse dimension relative to the proximal end opening;

a cylindrical cap having a second bore for axially receiving said body, said cap having proximal and distal ends with openings at each end in communication with the second bore, the cap proximal end opening being restricted in transverse dimension relative to the distal end opening, the cap distal opening being sufficient to receive said body therethrough;

expandable jaw cartridge means for placing said balls in said lock and unlock states, said jaw cartridge means including a collar and ball operating hollow core expandable jaws extending from the collar and a plunger including a jaw expanding portion resiliently secured in said core for selectively expanding said jaws in response to axial displacement of said plunger, said plunger including a shaft, said jaws being dimensioned to pass through the body distal end opening and the collar being dimensioned greater than said distal end opening such that the collar is retained in said first bore and said jaws extend beyond said distal end, said cartridge means including means in said first bore coupled to said shaft and collar for permitting resilient axial displacement of said shaft relative to the body for selective expansion of said jaws, said shaft having a portion which passes through said cap proximal end opening with the body received in the cap bore; and means for releaseably securing the cap to said body with said shaft portion extending through said cap proximal end opening;

said shaft portion having an opening, said means for releasably securing comprising handle means including means which mate with said shaft opening for releasably securing the handle means to said shaft portion so the cap and cartridge means can be removed by hand from the body without tools.

2. The key of claim 1 wherein said opening is a hook shaped slot in a side of said shaft, said handle means comprising a cam portion and a handle portion extending from the cam portion, said cam portion including a pin dimensioned to be received in said slot through said shaft side, said cam portion being dimensioned to cam against said cap proximal end at a cam surface with said pin attached to said shaft for selectively withdrawing said shaft from said cap and body for said resilient axial displacement.

3. The key of claim 2 wherein the cam surface lies on a portion of a surface of revolution relative to a given axis, said pin extending in said given axis, said slot being dimensioned from said cap proximal end a dimension smaller than the smallest distance between said pin and said surface of revolution so that the shaft must be axially displaced out of said cap to engage the pin in said slot.

4. The key of claim 1 wherein said means for releasably securing the cap comprises threaded engagement of said cap to said body and said handle means includes cam means for causing said axial displacement of said plunger.

5. A repairable key for use with a plunger lock having a pair of expandable balls in a cavity in which the key is inserted to selectively expand the balls to a locking state or retract the balls to an unlock state, said key comprising:

a cylindrical body having an axis with an axially extending first bore, said body having a proximal end and a distal end with openings at each end in communication with the bore, the distal end opening being restricted in transverse dimension relative to the proximal end opening;

a cylindrical cap having a second bore for axially receiving said body, said cap having proximal and distal ends with openings at each end in communication with the second bore, the cap proximal end opening being restricted in transverse dimension relative to the distal end opening, the cap distal opening being sufficient to receive said body therethrough;

expandable jaw cartridge means for placing said balls in said lock and unlock states, said jaw cartridge means including a collar and ball operating hollow core expandable jaws extending from the collar and a plunger including a jaw expanding portion resiliently secured in said core for selectively expanding said jaws in response to axial displacement of said plunger, said plunger including a shaft, said jaws being dimensioned to pass through the body distal end opening and the collar being dimensioned greater than said distal end opening such that the collar is retained in said first bore and said jaws extend beyond said distal end, said cartridge means including means in said first bore coupled to said shaft and collar for permitting resilient axial displacement of said shaft relative to the body for selective expansion of said jaws, said shaft having a portion which passes through said cap proximal end opening with the body received in the cap bore; and means connected to said shaft and to said cap for releaseably securing the cap to said body with said shaft portion extending through said cap proximal end opening so the cap and cartridge means can be removed by hand from the body without tools.

6. The key of claim 5 wherein said means connected to the shaft and cap comprises a cam member and a handle connected to the cam member, said cam member including means for releaseably rotatably connecting the cam member to the shaft external the cap such that the cam member can be rotated relative to the shaft against the cap for withdrawing the shaft and plunger in a direction to expand said jaws as said cam member is rotated.

7. The key of claim 6 wherein the shaft has a slot in a side thereof and the cam member has a pin which is slidably engagable with the slot, said pin being located in the cam member such that the shaft must be resiliently withdrawn from the cap to engage the pin and slot thereby resiliently releaseably securing the cam member to the cap.

8. The key of claim 7 wherein the cap is manually releaseably threaded to the body.

9. A repairable key for use with a plunger lock having a pair of expandable balls in a cavity in which the key is inserted to selectively expand the balls to a locking state or retract the balls to an unlock state, said key comprising:

a cylindrical body having an axis with an axially extending first bore, said body having a proximal end and a distal end with openings at each end in communication with the bore, the distal end opening being restricted in transverse dimension relative to the proximal end opening, the proximal end having first connection means;

a cylindrical cap having a second bore for axially receiving said body, said cap having proximal and distal ends with openings at each end in communication with the second bore, the cap proximal end opening being restricted in transverse dimension relative to the distal end opening, the cap distal opening being sufficient to receive said body therethrough, said cap including second connection means for releaseable connection to said first connection means for manually attaching the cap to the body by hand without tools;

expandable jaw cartridge means for placing said balls in said lock and unlock states, said jaw cartridge means including a collar and ball operating hollow core expandable jaws extending from the collar and a plunger including a jaw expanding portion resiliently secured in said core for selectively expanding said jaws in response to axial displacement of said plunger, said plunger including a shaft, said jaws being dimensioned to pass through the body distal end opening and the collar being dimensioned greater than said distal end opening such that the collar is retained in said first bore and said jaws extend external said distal end, said cartridge means including means in said first bore coupled to said shaft and collar for permitting resilient axial displacement of said shaft relative to the body for selective expansion of said jaws, said shaft having a portion which passes through said cap proximal end opening with the body received in the cap bore; and cam means adapted to be releaseably connected to said shaft for selectively displacing the shaft in a direction to expand said jaws, said cam means being releaseably connected so the cap and cartridge means can be removed by hand from the body without tools.

10. A repairable key for use with a plunger lock having a pair of expandable balls and a cavity in which the key is inserted to selectively expand the balls to a locking state or retract the balls to an unlock state, said key comprising:

a cylindrical body having an axis with an axially extending first bore, said body having a proximal end and a distal end with openings at each end in communication with the bore, the distal end opening being restricted in transverse dimension relative to the proximal end opening;

a cylindrical cap having a second bore for axially receiving said body, said cap having proximal and distal ends with openings at each end in communication with the second bore, the cap proximal end opening being restricted in transverse dimension relative to the distal end opening, the cap distal opening being sufficient to receive said body therethrough;

expandable jaw cartridge means for placing said balls in said lock and unlock states, said jaw cartridge means including a collar and ball operating hollow core expandable jaws extending from the collar and a plunger including a jaw expanding portion resiliently secured in said core for selectively expanding said jaws in response to axial displacement of said plunger, said plunger including a shaft, said jaws being dimensioned to pass through the body distal end opening and the collar being dimensioned greater than said distal end opening such that the collar is retained in said first bore and said jaws extend beyond said distal end, said cartridge means including means in said first bore coupled to said shaft and collar for permitting resilient axial displacement of said shaft relative to the body for selective expansion of said jaws, said shaft having a portion which passes through said cap proximal end opening with the body received in the cap bore; and means for releaseably securing the cap to said body with said shaft portion extending through said cap proximal end opening so the cap and cartridge means can be removed by hand from the body without tools;

said means for releaseably securing the cap comprises threaded engagement of said cap to said body and cam means releaseably secured to said shaft portion for causing said axial displacement of said plunger.

* * * * *